US007882685B2

(12) United States Patent
Koga et al.

(10) Patent No.: US 7,882,685 B2
(45) Date of Patent: Feb. 8, 2011

(54) GRIPPER FOR AN AUTOMATIC BAG FILLING APPARATUS

(75) Inventors: Shoichi Koga, Iwakuni (JP); Kenji Kawamura, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 49 days.

(21) Appl. No.: 12/456,023

(22) Filed: Jun. 10, 2009

(65) Prior Publication Data

US 2009/0308031 A1 Dec. 17, 2009

(30) Foreign Application Priority Data

Jun. 11, 2008 (JP) ..... 2008-152584

(51) Int. Cl.
*B65B 43/46* (2006.01)

(52) U.S. Cl. ..... 53/570; 53/573; 53/384.1; 141/166

(58) Field of Classification Search ..... 53/570–573, 53/284.7, 384.1; 141/166, 168; *B65B 43/46*
See application file for complete search history.

(56) References Cited

U.S. PATENT DOCUMENTS

| | | | | |
|---|---|---|---|---|
| 4,263,768 | A * | 4/1981 | Russell et al. | 53/384.1 |
| 5,119,615 | A * | 6/1992 | Kujubu et al. | 53/573 |
| 5,182,898 | A * | 2/1993 | Tung et al. | 53/570 |
| 5,386,678 | A * | 2/1995 | Kujubu | 53/434 |
| 5,398,484 | A * | 3/1995 | Kader | 53/284.7 |
| 6,662,936 | B2 * | 12/2003 | Ikemoto et al. | 53/284.7 |
| 2002/0066260 | A1 * | 6/2002 | Hiramoto et al. | 53/571 |
| 2002/0148206 | A1 * | 10/2002 | Ikemoto et al. | 53/570 |
| 2003/0217528 | A1 * | 11/2003 | Wilson | 53/284.7 |
| 2004/0060266 | A1 * | 4/2004 | Gates | 53/570 |

FOREIGN PATENT DOCUMENTS

| | | | |
|---|---|---|---|
| FR | 2650807 | A1 * | 2/1991 |
| JP | S55-20178 | | 2/1980 |
| JP | S58-49706 | | 4/1983 |
| JP | 63272633 | A * | 11/1988 |
| JP | 04006024 | A * | 1/1992 |
| JP | 06122422 | A * | 5/1994 |
| JP | H6-144403 | | 5/1994 |
| JP | H6-156440 | | 6/1994 |
| JP | H7-37251 | | 4/1995 |
| JP | 2572954 | | 3/1998 |
| JP | 2001146211 | A * | 5/2001 |
| JP | 2002-302227 | | 10/2002 |

* cited by examiner

*Primary Examiner*—Stephen F Gerrity
(74) *Attorney, Agent, or Firm*—DLA Piper LLP (US)

(57) ABSTRACT

In an intermittently rotating table type bag filling apparatus, a plurality of pairs of grippers being provided at equal intervals around an intermittently rotating table, the grippers including pairs of left and right swing levers mounted on the intermittently rotating table, gripper arms affixed to swing levers, chuck sections installed in the tip end portions of the gripper arms, and chuck open/close mechanisms that open and close chuck sections. Gripper arms are cylindrical, and air cylinders and link mechanisms that constitute chuck open/close mechanism are installed inside the tube bodies of the gripper arms.

5 Claims, 4 Drawing Sheets

GRIPPER FOR AN AUTOMATIC BAG FILLING APPARATUS

BACKGROUND OF THE INVENTION

1. Field of the Invention

The present invention relates to a gripper used in an automatic bag filling apparatus for griping side edges of a bag.

2. Related Art

An intermittently rotating table type bag filling apparatus, for instance, is equipped with a table that rotates intermittently and a plurality of pairs of grippers that are installed around the periphery of the table at equal intervals and rotated intermittently together with the table. In this bag filling apparatus, while the table is making one rotation, one bag is supplied to the grippers, and the filling process that includes opening of the bag mouth, filling of the bag with contents, and, if necessary, sealing of the bag mouth, is performed with the bag being gripped at its both side edges by the grippers and hanged from the grippers.

Japanese Patent Application Laid-Open (Kokai) No. 1994-156440 discloses one example of grippers for an intermittently rotating table type bag filling apparatus, in which the grippers are comprised of: a pair of left and right swing levers mounted on an intermittently rotating table, gripper arms whose base end portions are respectively affixed to the swing levers, chuck sections provided in the tip end portions of the gripper arms to face inwardly and face each other, and a chuck open/close mechanisms that open and close the chuck sections. In this gripper, the chuck section is comprised of a fixed chuck element having a gripping part affixed to the gripper arm tip end so as to face in the direction opposite from the gripper arm base, and a movable chuck element installed at the tip end of the gripper arm so as to be rotated; and the chuck open/close mechanism is comprised of (a) a drive mechanism installed at an appropriate location on a base frame of the bag filling apparatus (for example, at the location where empty bags are supplied, or at the location where filled bags are discharged), (b) a link mechanism that includes, among others, rods, links and a passive member installed on the gripper arms and transmits the force of the drive mechanism to the movable chuck element, and (c) a spring installed on the gripper arms and constantly pushes the movable chuck element in the direction of closing.

However, this chuck open/close mechanism has several problems.

(1) A plurality of drive mechanisms must be installed on the periphery of the underside of the table, and thus the mechanism takes up spaces, makes the structure more complex, increases the costs, and makes cleaning and maintenance more difficult.

(2) When a process to remove defective bags, a process to re-hold and weigh the bags, or the like, is added, and the chuck sections must be opened and closed once at a location where the process is executed, and this requires the drive mechanism for the chuck open/close mechanism to be linked (via a cam or the like) mechanically to the main (i.e., rotating table) drive mechanism, resulting in that it becomes difficult to change the design or to make modifications in order to newly install a drive mechanism, and adding the above-described processes is in itself difficult when there is not enough space on the frame of the bag filling apparatus.

(3) Though it is desirable to vary the gripping force of the chuck section depending on the material and thickness of the bag and depending on the amount of material to be filled in the bag, it is extremely difficult to replace the springs used in the chuck sections, and even skilled technicians require some time to do this.

Japanese Patent Application Publication (Kokoku) No. 1995-37251 discloses a chuck open/close mechanism that includes a linking mechanism of a toggle system instead of springs; and this mechanism has the same sorts of problems as that of the system disclosed in Japanese Patent Application Laid-Open (Kokai) No. 1994-156440.

Japanese Utility Model Application Laid-Open (Kokai) No. 1983-49706 and Japanese Patent Application Laid-Open (Kokai) No. 1980-20178 disclose bag filling apparatuses in which the movable chuck element is driven by a single-acting air cylinder.

The bag filling apparatus disclosed in Japanese Utility Model Application Laid-Open (Kokai) No. 1983-49706 is an intermittently rotating table type bag filling apparatus; and in this apparatus, air cylinders are installed in the space which is next to each gripper arm on the intermittently rotating table; accordingly, the space occupied by each gripper pair is much greater, and the number of gripper pairs that are installed on the table is limited; and if the number of gripper pairs is to be increased, then the table (and as a result the entire bag filling apparatus) needs to made larger. There is no description in Japanese Utility Model Application Laid-Open (Kokai) No. 1983-49706 about the supply of bags; however, in the apparatus of this relevant art, the fixed chuck elements are installed on the outside of the movable chuck element (when viewed from the center of the table); accordingly, the gripper arms must be opened and closed in order to prevent interference between the fixed chuck elements and the bag when bags are supplied from the outer circumference of the table. This decreases the productivity due to the time required to do so. Furthermore, in the bag filling apparatus of this relevant art, the linking mechanism that links the air cylinder and the chuck section is exposed; accordingly, it is susceptible to becoming dirty, and the apparatus is low in cleaning and maintenance characteristics.

Japanese Patent Application Laid-Open (Kokai) No. 1980-20178 relates to a fixed bag filling apparatus and describes driving the movable chuck element with a single-acting air cylinder. In this bag filling apparatus, since the fixed chuck element is provided on the empty bag supply apparatus side, practically there is a high risk of the fixed chuck element interfering with the bags that are being supplied, and it may be necessary to have a sliding body (17) (an element that corresponds to the gripper arm) to avoid this. Thus, when the technology of Japanese Patent Application Laid-Open (Kokai) No. 1980-20178 is applied to, for example, an intermittently rotating table type bag filling apparatus, problems similar to those seen in Japanese Utility Model Application Laid-Open (Kokai) No. 1983-49706 would occur. Furthermore, in the apparatus of Japanese Patent Application Laid-Open (Kokai) No. 1980-20178, a rack and pinion mechanism is provided between the air cylinder and the chuck section (an element that corresponds to the mechanism linking to the chuck section), and this rack and pinion mechanism is exposed; accordingly, dirt tends to collect there, lowering the cleaning and maintenance characteristics.

BRIEF SUMMARY OF THE INVENTION

It is an object of the present invention to provide grippers used in, for instance, an automatic bag filling apparatus in which the grippers, though similar to those described in Japanese Patent Application Laid-Open (Kokai) No. 1994-156440, can reduce the installation space for a chuck open/ close mechanism, allow the process that opens and closes the chuck section necessary in a defective bag removal process and/or a re-holding and weighing process to be easily added when necessary, and facilitate changing the gripping force of the chuck section when necessary.

It is another object of the present invention to provide grippers used in, for instance, an automatic bag filling apparatus in which the grippers are prevented from generating such problems as reducing the productivity, expanding the apparatus size, and reducing the cleaning and maintenance characteristics that could occur in the systems disclosed in Japanese Utility Model Application Laid-Open (Kokai) No. 1983-49706.

The above objects are accomplished by a unique structure of the present invention for an improvement in the grippers used in an automatic bag filling apparatus in which a plurality of pairs of grippers are provided at equal intervals around a periphery of a transportation member that rotates continuously or intermittently, and the grippers grip both side edges of a bag and are rotated along a predetermined circular path together with the transportation member;

each pair of the grippers being comprised of a pair of left and right swing levers provided on the transportation member, gripper arms of which base end portions are respectively fixed to the swing levers, inwardly-facing chuck sections respectively provided in the tip end portions of the gripper arms to face each other, and chuck open/close mechanisms that open and close the chuck sections;

each of the chuck sections being comprised of a fixed chuck element having a gripping part provided at the tip end portion of the gripper arm and faces in an opposite direction from the base end portion of the gripper arm, and a movable chuck element rotatably provided at the tip end portion of the gripper arm; and each of the chuck open/close mechanism opening and closing the chuck section by rotating the movable chuck element; and in this gripper the gripper arms are in a tubular shape;

each of the chuck open/close mechanisms is comprised of:

an air cylinder installed inside a tube body of the gripper arm such that the tip end of the piston rod thereof faces toward the tip end of the gripper arm, and a link mechanism in which the tip end of the piston rod of the air cylinder is linked to the movable chuck element within the tube body of the gripper arm; and the movable chuck elements are rotated when the piston rods advance and retreat such that both chuck sections are closed when the movable chuck elements are rotated toward the fixed chuck elements and are closed when the movable chuck elements are rotated away from the fixed chuck elements.

Furthermore, in the present invention, the gripper arms can take a tubular shape;

each of the chuck open/close mechanisms can be comprised of:

an air cylinder that uses the tubular shape gripper arm as its cylinder tube and the tip end of the piston rod of the air cylinder faces toward the tip end of the tubular shape gripper arm, and a link mechanism in which the tip end of the piston rod of the air cylinder is linked to the movable chuck element within the tubular shape gripper arm; and the movable chuck elements are rotated when the piston rods advance and retreat such that both chuck sections are closed when the movable chuck elements are rotated toward the fixed chuck elements and closed when the movable chuck elements are rotated away from the fixed chuck elements.

The above-described grippers of the present invention may take the following specific format:

(1) the air cylinder can be a double-acting air cylinder, and (2) in an automatic bag filling apparatus, the transportation member is an intermittently rotating table, and the grippers grip a bag in such a manner that the bag is hanging down; and while the table makes its single rotation, a bag is supplied to the grippers, and a filling process including opening of the bag mouth, filling of the bag with contents, and, if necessary, sealing of the bag mouth are performed sequentially for the bag gripped by the grippers.

As seen from the above, according to the grippers of the present invention, the chuck open/close mechanisms for the grippers are simple in structure, and the installation space can be small. Furthermore, it is easily possible to add a process that opens and closes the chuck sections and is used in a process for removing defective bags and/or a process for re-holding and weighing the bags when necessary, and in addition, it is easily possible to change the gripping force of the chuck sections when necessary. In addition, it is also possible to provide grippers that do not create such problems as reducing the productivity, expanding the apparatus size, and reducing the cleaning and maintenance characteristics that could be foreseen in the grippers disclosed in Japanese Utility Model Application Laid-Open (Kokai) No. 1983-49706 and Japanese Patent Application Laid-Open (Kokai) No. 1980-20178.

DETAILED DESCRIPTION OF THE INVENTION

The grippers of the present invention used in an automatic bag filling apparatus will be described in detail below with reference to the accompanying drawings.

Figure 1:
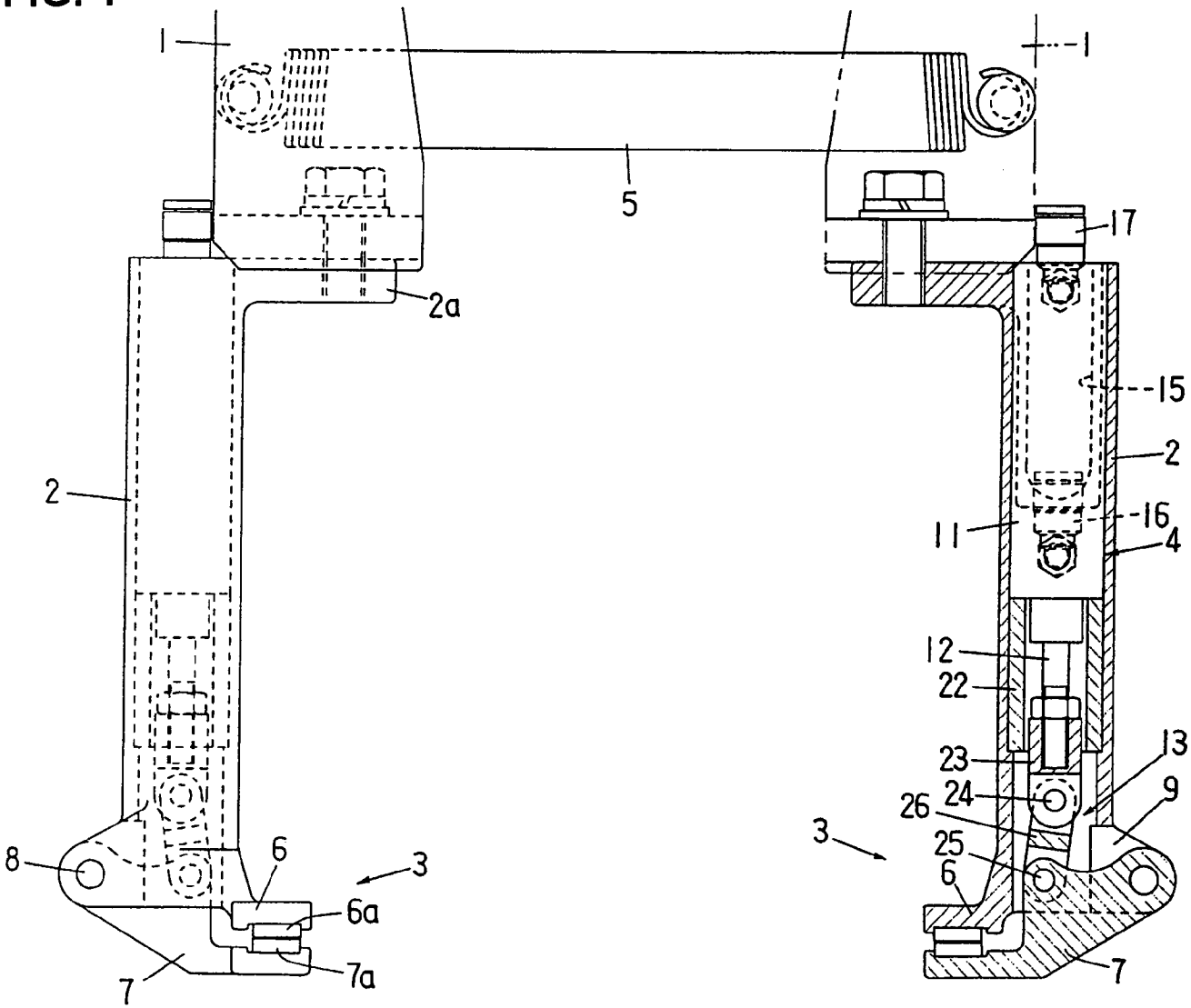
FIG. 1 is a partially cross-sectional top view of the grippers according to the present invention.
Figure 2:
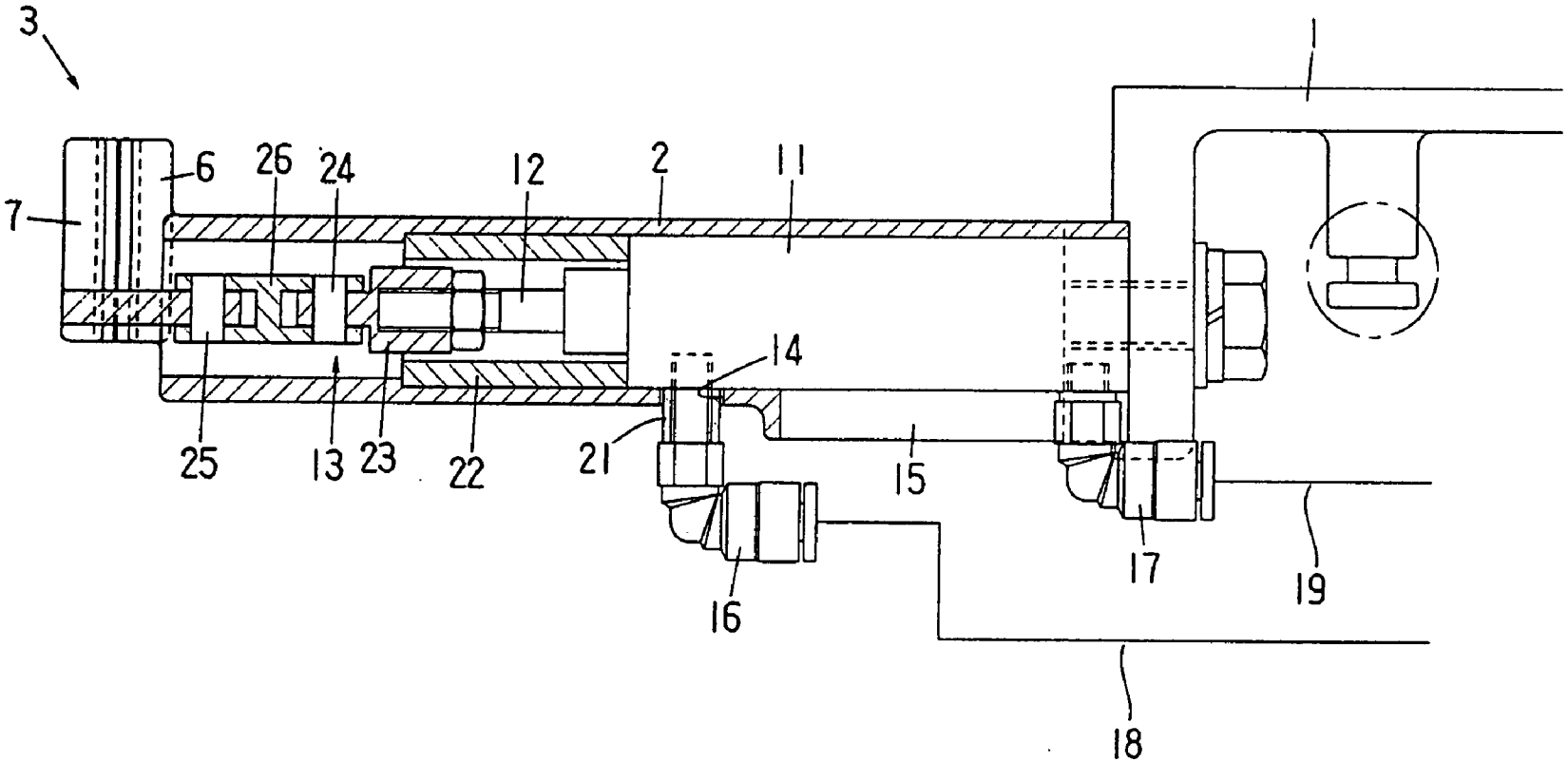
FIG. 2 is a cross-sectional side view thereof.
Figure 3:
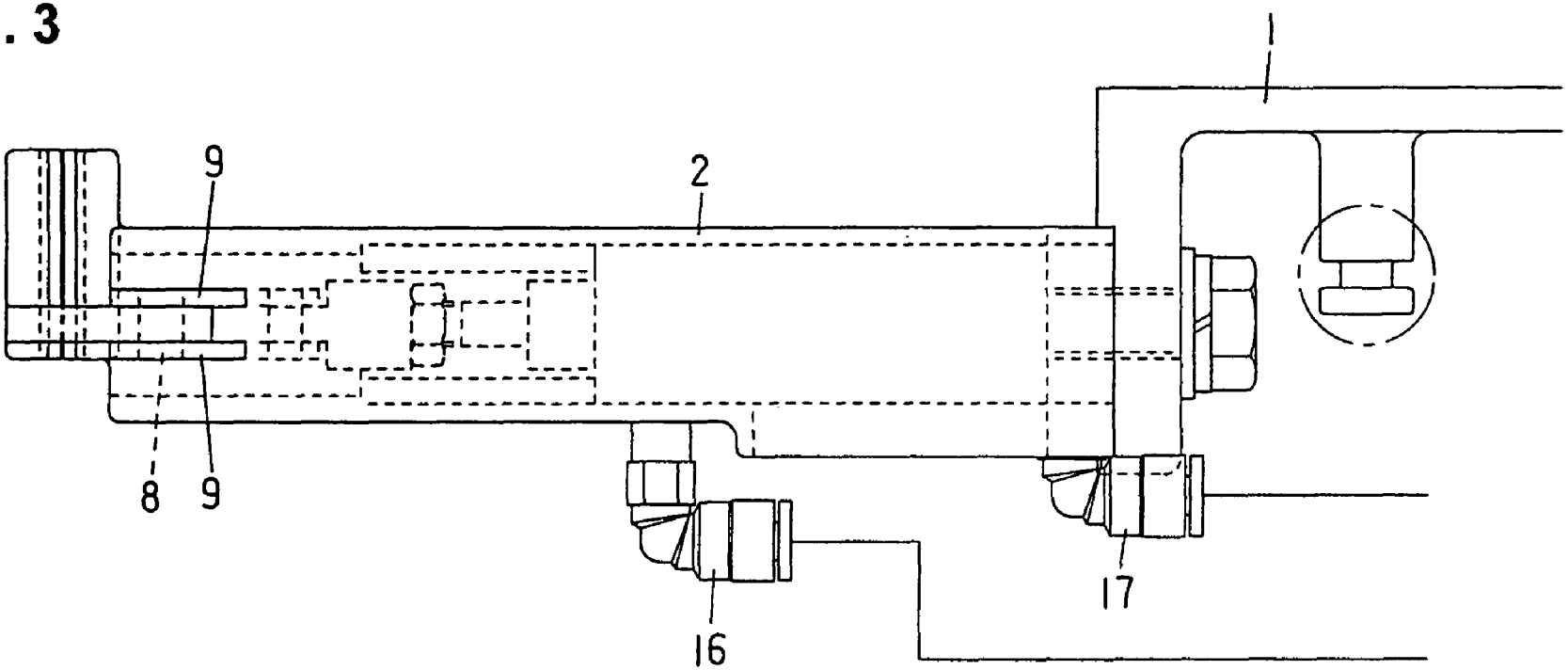
FIG. 3 is a side view thereof.

The grippers shown in FIGS. 1 through 3 are employed in an intermittently rotating table type bag filling apparatus and the same type as those of Japanese Patent Application Laid-Open (Kokai) No. 1994-156440. The shown grippers are thus one of a plurality of pairs of grippers provided at equal intervals on a table (not shown) that rotates intermittently.

The grippers are comprised of a pair of left and right swing levers 1, which are swingably provided in a horizontal plane that is parallel to the table, and tubular gripper arms 2, which are affixed at their brackets 2*a* formed at the base end portions to the swing levers 1. The grippers further include, respectively, a chuck section 3 installed in the tip end portion of each gripper arm 2, and a chuck open/close mechanism 4 installed inside the tube body of the gripper arm 2.

The pair of swing levers 1 and 1 are urged inwardly by a spring 5, so that the swing arms 1 swing symmetrically in the horizontal plane at a prescribed timing by a known mechanism as disclosed in Japanese Utility Model Registration Number 2572954. The swing levers 1 and 1 thus open and close the pair of gripper arms 2 in the horizontal plane, so that the distance between the two chuck sections 3 and 3 can be adjusted in a known format.

The chuck sections 3 and 3 are provided to face each other at the tip end portions of the gripper arms 2 and 2 so that they face inwardly. Each one of the chuck sections 3 is comprised of a fixed chuck element 6 and a movable chuck element 7. The fixed chuck element 6 is fixed to the tip end of the gripper arm 2 so that its gripping part 6*a* faces opposite from the base end portion (which is on the table side) of the gripper arm 2. The movable chuck element 7 has a gripping part 7*a* that grips the side edge of a bag in cooperation with the gripping part 6*a* of the fixed chuck element 6. The movable chuck element 7 is axially supported at its base end by a shaft 8 that is installed at the tip end of the gripper arm 2, so that the movable chuck element 7 is rotatable in the horizontal plane. The shaft 8 is provided in the supporting area 9 formed integrally on the outer side of the tip end portion of the gripper arm 2. The chuck section 3 is closed when the movable chuck element 7 is rotated toward the fixed chuck element 6, and it is opened when the movable chuck element 7 is rotated in the opposite direction (or rotated away from the fixed chuck element 6).

The chuck open/close mechanism 4 provided in the gripper arm 2 is comprised of an air cylinder 11, which is installed inside the tube body of the gripper arm 2, and a linking mechanism 13, which links the piston rod 12 of air cylinder 11 to the movable chuck element 7. The air cylinder 11 is a double-acting air cylinder. As best seen from FIG. 2, pipe joints 16 and 17 are respectively threadedly-connected to the front and rear air inlet/outlet through hole 14 and elongated groove-shaped cut-out 15 both formed in the bottom of the gripper arm 2. In addition, air pipes 18 and 19 of the chuck open/close mechanism 4 are respectively connected at one end thereof to the pipe joints 16 and 17 and are also connected at another end thereof to pressurized air supply sources via, for instance, a switching valve (not shown). A rotation preventive spacer 21 is pressed into a part where the air inlet/outlet opening of the pipe joint 16 is connected to the hole 14. A positioning spacer 22 for defining the front end position of the air cylinder 11 that is installed inside the tube body of the gripper arm 2 is installed inside the tube body of the gripper arm 2. With the elongated groove-shaped cutout 15, the pipe joint 17 can be installed at any position in this cutout 15 so that it is connected to the gripper arm 2 even when the size (length) of the air cylinder 11 is changed.

The linking mechanism 13 is comprised of a linking element 23 that is crew-connected to the tip end of the piston rod 12 and a link 26 that connects the linking element 23 to the movable chuck element 7 via pins 24 and 25. One end of the link 26 is connected to the tip end of the linking element 23 by the pin 24, while the other end of the link 26 is connected to the center of the movable chuck element 7 by the pin 25. As a result, the movable chuck element 7 is rotated (thus opens and closes the chuck section 3) by the linking mechanism 13 when the piston rod 12 advances and retreats. In other words, when the piston rod 12 retreats, the movable chuck element 7 is rotated toward the fixed chuck element 6 and closes chuck section 3; and when the piston rod 12 advances, the movable chuck element 7 is rotated in the opposite direction to open the chuck section 3.

When both chuck sections 3 are in the opened state, the movable chuck elements 7 are opened in the forward direction (the direction opposite from the table). Accordingly, when a bag is supplied to the grippers from the front, there is no interference between the bag and the movable chuck elements 7 even when the gripper arms 2 themselves are not opened in the horizontal plane as in Japanese Patent Application Laid-Open (Kokai) No. 1994-156440. This means that there is no loss of time for opening and closing the gripper arms 2 when bags are supplied, and there is no risk of lowering the productivity.

In the above-described grippers, the air cylinders 11 are employed for the chuck open/close mechanisms 4. Accordingly, they do not require as much space as the gripper open-and-close mechanism described in Japanese Patent Application Laid-Open (Kokai) No. 1994-156440, and the structure itself is simpler. In addition, since the chuck sections 3 are opened and closed by the actions of the switching valves (that are connected to the air pipes 18 and 19) at any position of the table during one rotation thereof; accordingly, addition of processes such as a defective bag removal process and/or a re-holding and weighing process can be easily done, and further, there is no need for extra design changes or modification work for the opening and closing actions of the chuck sections. It is also easy to change the gripping force of the chuck sections.

In the above-described grippers, the chuck open/close mechanism (air cylinder 11 and linking mechanism 13) is provided inside the tube body of each one of the gripper arms 2. Accordingly, the surrounding of the gripper arms 2 is cleared, assuring excellent cleaning and maintenance characteristics. Also, even though the air cylinder 11 is used as the drive source for chuck open/close mechanism 4, a pair of grippers can occupy the same space as or even less space than the equivalent grippers disclosed in Japanese Patent Application Laid-Open (Kokai) No. 1994-156440, and thus it is possible to prevent the table from becoming too large.

Furthermore, though the above-described grippers use the double-acting air cylinders 11, single-acting air cylinders can be used instead. When a single-acting air cylinder is used, a piston rod that acts in a single direction by air pressure returns in the opposite direction by, for example, spring bias pressure; and thus in this structure, it is desirable to design it so that pressure by the air cylinder is used when the movable chuck element 7 is closed, and pressure by the spring is used when the movable chuck element 7 is opened. This is because this setting facilitates adjustment of the gripping force of the chuck sections 3. In this case, the above-described spring is also installed inside the tube body of the gripper arm 2. However, in a single-acting air cylinder, the piston rod tends not to return properly if the spring has insufficient strength and air pressure that is higher as much as the strength of the spring is (further) required in order to produce the required gripping force; accordingly, it is desirable to use a double-acting air cylinder.

Furthermore, in the above-described grippers, the movable chuck element 7 is rotated toward the fixed chuck element 6 to close the chuck section 3 when the piston rod 12 retreats, and movable chuck element 7 is rotated in the opposite direction to open the chuck section 3 when the piston rod 12 advances. It is also possible to set so that the direction of the rotation of the movable chuck element and the direction of the advance and retreat of the piston rod 12 are reversed.

In addition, the above-described grippers are used in an intermittently rotating table type bag filling apparatus. However, the grippers of the present invention can be used, for instance, in a continuously rotating table type bag filling apparatus, in a bag filling apparatus in which a chain that rotates along a circular path is the transportation member (see, for example, Japanese Patent Application Laid-Open (Kokai) No. 2002-302227), or in a horizontal-type bag filling apparatus in which the bags are, when transported, on their sides and not being suspended vertically and the filling operation is performed during the transportation (see, for example, Japanese Patent Application Laid-Open (Kokai) 1994-144403).

Figure 4:
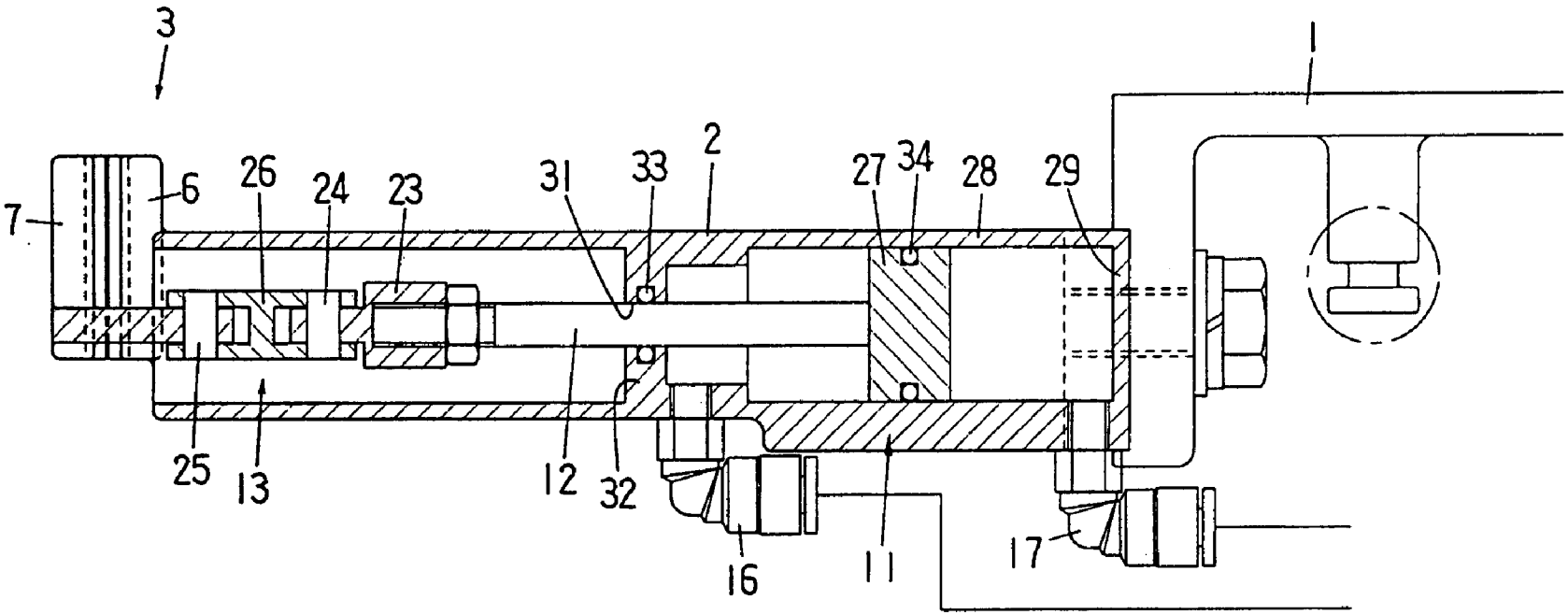
FIG. 4 is a cross-sectional side view of the grippers according to another aspect of the present invention.

FIG. 4 shows another type of grippers according to the present invention. In the grippers of FIG. 4, parts that are substantially the same as those of the grippers shown in FIGS. 1 through 3 are given the same reference numerals.

The grippers shown in FIG. 4 differ from the grippers shown in FIGS. 1 through 3 in that the gripper arms 2 are used as the cylindrical tube body of the air cylinder 11; and the other elements are essentially the same as those of the grippers of FIGS. 1 through 3.

More specifically, as seen from FIG. 4, the piston 27 of the air cylinder 11 is provided so that it slides forward and backward inside the tube body of the gripper arm 2 (the interior of the cylindrical tube 28), the rear end of the gripper arm 2 is closed by the rear wall 29, and a separating wall 32 which has a hole 31 through which the piston rod 12 passes is provided in the middle portion of the gripper arm 2. An O-ring 33 is provided to create a seal between the piston rod 12 and the hole 31. In addition, two air inlets/outlets (threaded holes) are provided in a part of the cylindrical wall (the wall part of the cylindrical tube 28) of the gripper arm 2 that is located between the rear wall 29 and the separating wall 32, and pipe joints 16 and 17 for introducing pressurized air into the space between the rear wall 29 and the separating wall 32 are respectively threadedly-connected to the air inlets/outlets. The piston rod 12 is connected to the movable chuck element 7 via the linking mechanism 13 disposed inside the tube body of the gripper arm 2. The reference numeral 34 is an O-ring.

In the structure described above, the gripper arm 2 itself serves as the cylinder tube 28 of the air cylinder 11; accordingly, compared to the grippers of FIGS. 1 through 3, the number of the parts is smaller, and the structure is simpler.

The invention claimed is:

1. A gripper for an automatic bag filling apparatus, wherein
- a plurality of pairs of grippers are provided at equal intervals around a periphery of a transportation member that rotates continuously or intermittently, and
- said plurality of pairs of grippers respectively grip both side edges of a bag and are rotated along a predetermined circular path together with said transportation member;
- each pair of said grippers being comprised of:
  - a pair of left and right swing levers provided on said transportation member,
  - gripper arms of which base end portions are respectively fixed to said swing levers,
  - inwardly-facing chuck sections respectively provided in tip end portions of said gripper arms to face each other, and
  - chuck open/close mechanisms that open and close said chuck sections;
- each of said chuck sections being comprised of:
  - a fixed chuck element having a gripping part provided at the tip end portion of said gripper arm and faces in an opposite direction from the base end portion of said gripper arm, and
  - a movable chuck element rotatably provided at the tip end portion of said gripper arm; and
- each of said chuck open/close mechanism opening and closing said chuck section by rotating said movable chuck element; and
- wherein
- said gripper arm is in a tubular shape;
- said chuck open/close mechanism is comprised of:
  - an air cylinder installed inside a tube body of said gripper arm such that a tip end of a piston rod thereof faces toward a tip end of said gripper arm, and
  - a link mechanism in which said tip end of said piston rod of said air cylinder is linked to said movable chuck element within said tube body of said gripper arm; and
- said movable chuck element is rotated when said piston rod advances and retreats.

2. A gripper for an automatic bag filling apparatus, wherein
- a plurality of pairs of grippers are provided at equal intervals around a periphery of a transportation member that rotates continuously or intermittently, and
- said plurality of pairs of grippers respectively grip both side edges of a bag and are rotated along a predetermined circular path together with said transportation member;
- each pair of said grippers being comprised of:
  - a pair of left and right swing levers provided on said transportation member,
  - gripper arms of which base end portions are respectively fixed to said swing levers,
  - inwardly-facing chuck sections respectively provided in tip end portions of said gripper arms to face each other, and
  - chuck open/close mechanisms that open and close said chuck sections;
- each of said chuck sections being comprised of:
  - a fixed chuck element having a gripping part provided at the tip end portion of said gripper arm and faces in an opposite direction from the base end portion of said gripper arm, and
  - a movable chuck element rotatably provided at the tip end portion of said gripper arm; and
- each of said chuck open/close mechanism opening and closing said chuck section by rotating said movable chuck element; and
- wherein
- said gripper arm is in a tubular shape;
- said chuck open/close mechanism is comprised of:
  - an air cylinder that uses said tubular shape gripper arm as a cylinder tube thereof and a tip end of a piston rod of said air cylinder faces toward a tip end of said tubular shape gripper arm, and
  - a link mechanism in which said tip end of said piston rod of said air cylinder is linked to said movable chuck element within said tubular shape gripper arm; and
- said movable chuck element is rotated when said piston rod advances and retreats.

3. The gripper for an automatic bag filling apparatus according to claim 1 or 2, wherein said air cylinder is a double-acting air cylinder.

4. The gripper for an automatic bag filling apparatus according to claim 1 or 2, wherein
- said transportation member is an intermittently rotating table, and
- said grippers grip the bag in a hanging state, and
- wherein during one rotation of said table, a bag is supplied to said grippers, and a filling process including opening of a mouth of the bag and filling of the bag with contents is performed sequentially for the bag gripped by said grippers.

5. The gripper for an automatic bag filling apparatus according to claim 3, wherein
- said transportation member is an intermittently rotating table, and
- said grippers grip the bag in a hanging state, and
- wherein during one rotation of said table, a bag is supplied to said grippers, and a filling process including opening of a mouth of the bag and filling of the bag with contents is performed sequentially for the bag gripped by said grippers.

* * * * *